United States Patent [19]

Mikusch et al.

[11] Patent Number: 4,627,528

[45] Date of Patent: Dec. 9, 1986

[54] CONVEYING SYSTEM FOR MULTIPLE DIE PRESSES OR PRESS LINES

[75] Inventors: Gerald Mikusch; Wolfgang Hübner; Werner Münch, all of Göppingen, Fed. Rep. of Germany

[73] Assignee: L. Schuler GmbH, Göppingen, Fed. Rep. of Germany

[21] Appl. No.: 521,370

[22] Filed: Aug. 8, 1983

[30] Foreign Application Priority Data

Aug. 12, 1982 [DE] Fed. Rep. of Germany ..... 3229943

[51] Int. Cl.[4] ..... B65G 25/00

[52] U.S. Cl. ..... 198/621; 198/774

[58] Field of Search ..... 198/774, 621, 750; 414/749, 750, 751

[56] References Cited

U.S. PATENT DOCUMENTS

| | | | |
|---|---|---|---|
| 3,911,754 | 10/1975 | Pitto | 74/102 |
| 4,436,199 | 3/1984 | Baba et al. | 198/621 X |

FOREIGN PATENT DOCUMENTS

| | | | |
|---|---|---|---|
| 1271067 | 6/1968 | Fed. Rep. of Germany . | |
| 2004509 | 8/1971 | Fed. Rep. of Germany . | |
| 35451 | 11/1965 | German Democratic Rep. | 198/774 |
| 891262 | 3/1962 | United Kingdom | 198/774 |
| 703437 | 12/1979 | U.S.S.R. | 198/774 |

*Primary Examiner*—Joseph E. Valenza
*Assistant Examiner*—Michael Stone
*Attorney, Agent, or Firm*—Barnes & Thornburg

[57] ABSTRACT

For the conveying of work pieces from one treatment step to the next and for release after the treatment, gripping devices are arranged at gripper rails that can be lifted and lowered wherein the lowest and the highest position of the gripper rails can be adjusted via a pulley that can be placed against cam parts carried along by the slide of the press, via a step-up gear and a lever system. The change of the gripping devices is to be carried out together with the tool change. For this purpose, the gripper rails are led into the lowest position, which position can be adjusted via a regulating means independently from the position of the slide.

10 Claims, 4 Drawing Figures

CONVEYING SYSTEM FOR MULTIPLE DIE PRESSES OR PRESS LINES

This invention relates to a conveying system for multiple-die presses or press lines having gripper rails extending in the conveying direction of the work pieces and carrying gripper devices that interact for gripping the work pieces, with said gripper rails being affected by interruptable driving movements led off the drive of the press for the lifting and lowering movement of the gripper system.

In the case of multiple die presses and press lines, it is often necessary to stop the ejecting process of a work piece in order to carry out certain other treatment steps. In addition, it should be possible to carry out a change of the gripping devices together with the tool change, with the gripping devices being located at a level where they can be manipulated for removal, new mounting and set-up.

On the basis of DE-AS No. 12 71 067, a conveying system is known for the conveying of work pieces between presses. In this case, a gripper rail system is used that extends through the whole press line. The gripper rails are driven by the press drive in a closing - lifting - forward - lowering - opening - lifting - backward cycle. In the drive of the gripper rails that is led off the press drive, a cam is arranged on the crankshaft for the lifting-lowering movement, with a control pulley acted upon by a compressed-air cylinder being placed against said cam. The movement of the control pulley on the cam is transmitted to the gripper rails for their highest and lowest position. The double-acting compressed-air cylinder, with a corresponding reversing of the control medium into the cylinder, makes it possible for the control pulley to be lifted off the cam. Thus a drawing press stroke can be carried out without an action of the gripper system and a movement of the gripper rails can take place without the press stroke. An automatic conveying of the gripper rails into a position that is different from the position caused by the drive cannot be achieved in this way.

Also, a drive for the opening and closing of gripper rails is known from DE-OS No. 20 04 509. The operating movement for this movement is picked up via a cam from the slide movement. The control movement is deflected by a control pulley that, via a compressed-air cylinder, is continuously placed against the cam and, via rack-and-pinion/toothed gear drives, is deflected into a longitudinal movement for operating the gripper rails. Movements for achieving another starting position that exceed these movements are not provided in this case.

It is an object of the invention in the case of a system of the initially mentioned type where a change of grippers takes place in connection with the tool change, is to achieve an end position, possibly the lowest position of the gripper system, in one case depending on the slide drive, in the other case, not depending on the slide drive, with the exactly defined highest position of the gripper system being reachable in an intermediate position that is overtravelled in the case of an adjusting movement of the regulating unit from one end position into the second end position.

It is another object of the present invention to provide a press-driven cam having cam parts for the highest position and the lowest position of the gripper, a control pulley on a deflecting lever, with said control pulley interacting with the cam, a regulating unit that can be operated into the positions constituting the highest and the lowest position of the gripper system and also into a position that lifts the control pulley off the cam, and by a lever mechanism having a joint coupling point for the coupling of the control pulley and the regulating unit and having a pickup point coupled at the gripper system, where the lever system can be adjusted between two end positions in which the gripper system is in its lowest position, and a central position in which the gripper system is in its highest position.

It is another object of the invention to provide a conveying system wherein the conveying movement and especially the ejecting of the work pieces can be stopped and the gripping devices can be changed together with the tool and may remain at or in the tool.

It is another object to provide a conveying system wherein cam parts of a cam are essentially linear contact areas for a control pulley, as a result of the pickup of the linear movement of the slide.

It is another object of the invention to provide a lever system with a toggle joint disposed at a gripper system between a joint coupling point of a control pulley and regulating unit and a pickup point having advantages resulting from three definable positions of the system in connection with an adjusting unit that is movable in two end positions, and where the stretched position of the toggle joint can be assigned to an intermediate position that can be overtravelled during the adjusting movement of the regulating unit.

These and other objects, features, and advantages of the present invention will become more apparent from the following description when taken in connection with the accompanying drawings which show, for the purposes of illustration only, a plurality of embodiments in accordance with the present invention, like reference numerals being used throughout to represent like elements, and wherein.

Figures 1, 2:
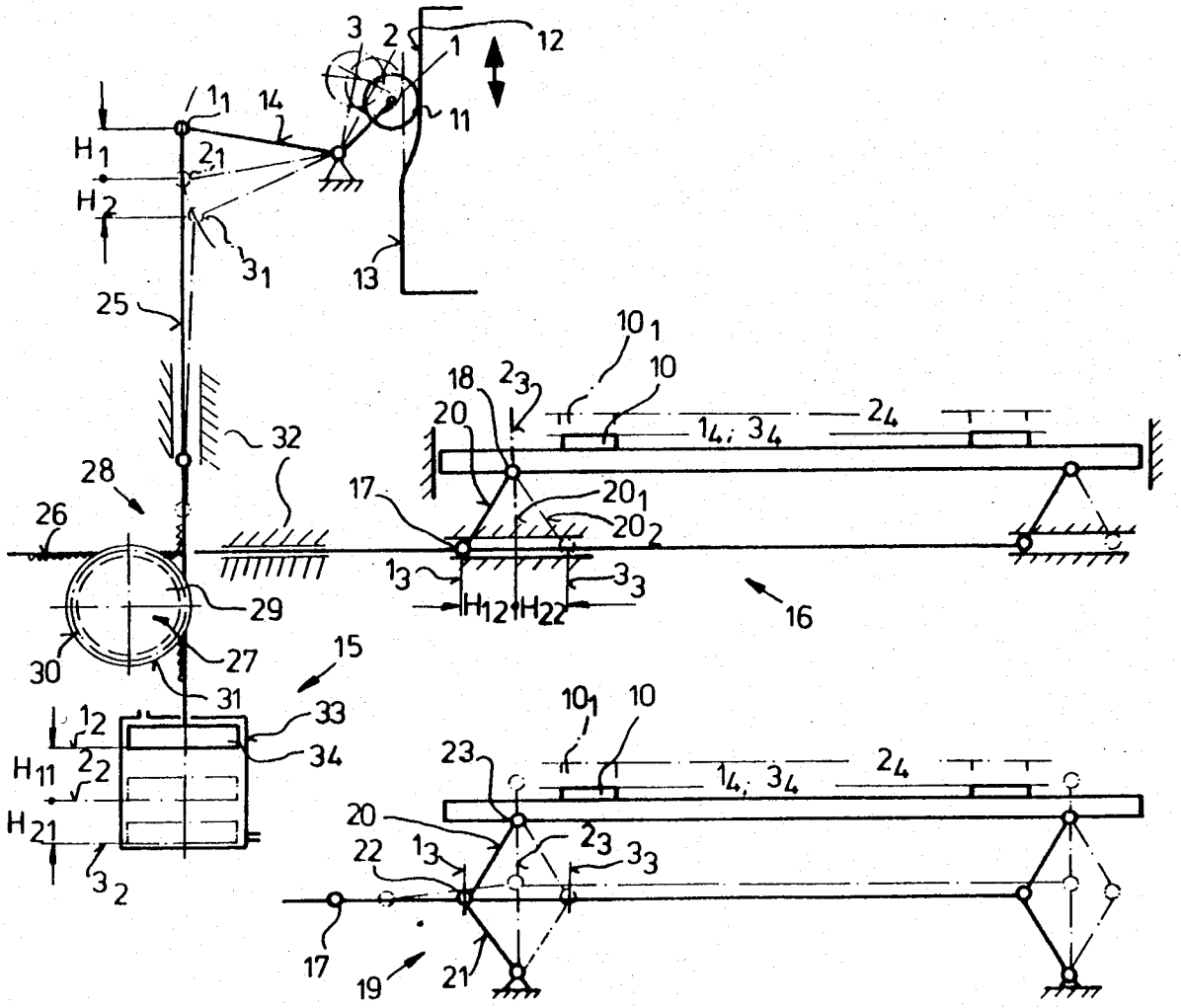
FIG. 1 is a diagrammatic view of a first conveying system according to the invention.
FIG. 2 is a diagrammatic view of a second conveying system according to the invention having a toggle joint system.
Figures 3, 4:
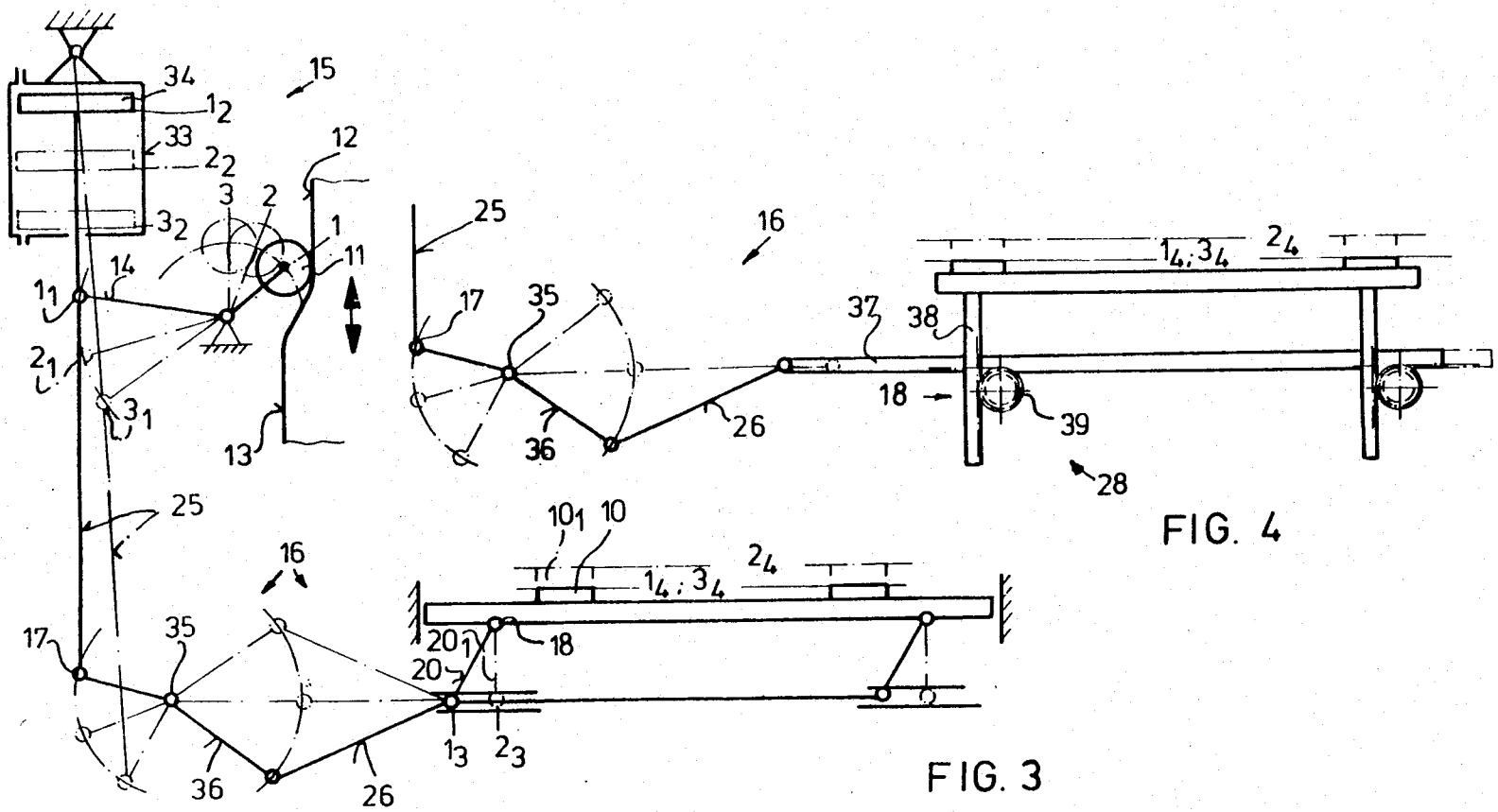

FIG. 3 shows another development according to the invention with a simple deflection according to the invention; and FIG. 4 shows another development according to the invention with rack-and-pinion/toothed-wheel deflecting gears Referring now to FIGS. 1 and 2, the gripper rails 10 that are guided through the press line or a multiple die press must be lifted from the position shown by the solid line into the positon $\mathbf{10}_1$ indicated by segmented lines and lowered from this position in order to replace the work piece inserted into a tool by a following work piece and in order to be able to change the gripping devices together with the tool. The mechanisms according to the figures have a deflection lever 14 mounted firmly at the frame which by means of the control pulley 11 disposed at an end of deflection lever 14 can be placed against cam parts 12, 13 at the slide that can be moved in the direction indicated by the arrow. The deflection of the control pulley 11 may also be caused via a cam plate that is directly or indirectly operated by the press drive. During the stroke movement of the slide, the control pulley 11 can therefore be adjusted from position 1 which can correspond to the lowered position of the gripping tools, to position 2 which can correspond to the lifted position of the gripping tools.

The second end of the deflecting lever 14 in this case moves from position $1_1$ to position $2_1$ and in the process the adjusting rod 25 is adjusted by the extent $H_1$. The adjusting movement is transmitted to the toothed wheel 29 according to FIGS. 1 and 2. This may be a double-toothed spur wheel for changing the movements such as $H_1$ and $H_2$ to a smaller, or possibly larger movement of the adjusting rod 25. Positions 30 and 31 refer to two toothed rings of different reference and outside diameters. Reference numeral 28 is the general position reference of the changing drive which, as shown in FIGS. 3 and 4, may also be a lever system 16 and the transmission or step-down ratio of which is the result of the position of the deflection point 27 (FIGS. 1 and 2), and 35 (FIGS. 3 and 4), with respect to the coupling points of the adjusting rods 25 and 26 at said lever system. The adjusting rods 25 and 26 are guided via guide means 32, FIG. 1. A regulating unit 15 that can be adjusted in two end positions is applied to the adjusting rod 25, with said regulating unit, in the shown embodiment, being a double-action compressed-air cylinder 15. The control piston 34, responding to the admission of pressure which effects the positioning of the control pulley 11 against the cam parts 12, 13, and under the influence of this adjustment, can be adjusted from position $1_2$ by the extent $H_{11}$ to the position $2_2$ when the control pulley 11 is adjusted from position 1 to position 2. When the compressed-air chamber is reversed, the control piston 34 is guided from position $2_2$ or position $1_2$ to position $3_2$ by the extent $H_{21}$ or by the incremental dimension $H_{11}$ and $H_{21}$. At the same time, the control pulley 11 is lifted off the cam into a position, shown as position 3, by means of which the gripper rails 10 are guided into a position which is independent from the movement of the slide. This is achieved by different forms of deflection in FIGS. 1, 2 and 4.

In FIG. 1, the adjusting rod 26, via the joint coupling point 17 for the control pulley 11 and the regulating unit 15, is coupled with a one-armed guide rod 20. While the coupling point 17, through a parallel guide not shown in detail, is guided at a right angle to the lifting movement of the gripper rails 10 and is moved in positions $1_3$, $2_3$ and $3_3$ which correspond to positions 1, 2 and 3 of the control pulley 11 or positions $1_2$, $2_2$ and $3_2$ of the regulating unit 15, the pickup point 18, while taking along the gripper rails 10, moves in the direction that is vertical in this case. The pickup point 18 together with the gripper rails 10, in positions $1_3$ and $3_3$ of the joint coupling point 17, will be in the lowest position and in position $2_3$, will be in the highest position. The adjusting distances $H_{12}$ and $H_{22}$, via the changing drive, are changed with respect to the adjusting distances $H_{11}$ and $H_{21}$ of the regulating unit 15.

In order to achieve the vertical movement of the gripper rails 10, a toggle joint 19 is used in FIG. 2, with the guide rod 21 which at one point of rotation is firmly attached to the frame, with said guide rod 21 via the center bearing 22 being connected with a second guide rod 20 which via the link bracket 23 as the pickup point is connected with the gripper rails 10. During the coupling of the joint coupling point 17 as the result of a movement of the slide or as the result of a deflection of the regulating unit, the center bearing will be moved between positons $1_3$, $2_3$ and $3_3$.

The deflection and the changing of the adjusting movement as a result of the movement of the slide or a deflection of the regulating unit 15 according to FIGS. 3 and 4 may take place via another deflecting lever 36 having the joint coupling point for the adjusting rod 25, the deflection point 35 and the pickup to the adjusting rod 26. The deflection of the adjusting movement into a lifting and lowering movement for the gripper rails 10, in FIG. 3 as in FIG. 1, takes place via the lever mechanism 16 on the condition that the guide rod 20 is moved between positions $1_3$ and $2_3$.

In FIG. 4, the deflection of the adjusting movement into a lifting and lowering movement for the gripper rails 10 takes place, with rack and pinion action via the step-up gear 28 consisting of the toothed adjusting rods 37 and 38 and the spur wheel 39 which may possibly be developed as a double gear wheel.

As a rule, gripper rails 10 occur in pairs so that double pickup points 18 must be provided correspondingly.

While we have shown and described several embodiments in accordance with the present invention, it is understood that the same is not limited thereto but is susceptible to numerous changes and modifications as known to one having ordinary skill in the art, and we therefore do not wish to be limited to the details shown and described herein, but intend to cover all such modifications as are encompassed by the scope of the appended claims.

We claim:

1. A conveying system for one of a multiple-die press and a press lien having gripper rail means extending in the conveying direction of the work pieces and carrying gripper devices that interact for gripping the work pieces, with said gripper rail means being responsive to interruptable driving movements led off the drive of the press for the lifting and lowering movement of the gripper rail means, comprising a press-driven cam means having cam parts for positioning the gripper rail means to a highest position and a lowest position, a control pulley on a deflecting lever for interacting with the cam means, a regulating means operable into positions corresponding to the highest and the lowest position of the gripper rail means and also into a position that lifts the control pulley off the cam means, and a lever means having a joint coupling point and coupled to the control pulley and the regulating means and having a pickup point coupled at the gripper rail means, positionable between a first end position to place the gripper rail means in its lowest position, and a second central position to place the gripper rail means in its highest position, and a third position to place the gripper rail means below the highest position for admitting removal of said gripper devices.

2. A conveying system according to claim 1, wherein the cam means comprises cam parts which have at least two essentially linear contact areas for the control pulley.

3. A conveying system according to claim 1, wherein the lever means comprises a toggle joint coupled to the joint coupling point.

4. A conveying system according to claim 3, wherein the joint coupling point for the control pulley and the regulating unit is coupled via a lever mounted to the toggle joint at a central bearing and the pickup point for the gripper rail means is coupled at a front link bracket of the toggle joint.

5. A conveying system according to claim 3, wherein between at least the deflecting lever for the control pulley and the toggle joint, an adjusting lever means is placed for deflecting and adjusting movement of the gripper rail means.

6. A conveying device according to claim 1, further comprising adjusting rods having teeth for adjusting movement of the gripper rail means and a driven means engaging the teeth for activating the adjusting movement.

7. A conveying device according to claim 1, wherein the lever means comprises changing drive means having a double gear wheel with two different reference diameters of the toothed rings thereof and an adjusting rod on a drive side and an adjusting rod on a power take-off side are via guide means applied to one of the toothed rings, respectively.

8. A conveying device according to claim 1, wherein the lever means comprises a deflecting lever means operable about a deflection point and connected to of the regulating unit and the control pulley and also to one end of an adjusting rod and a guide rod means connected at one of its ends to gripper rail means at the pickup point and connected at its second end within a slide to the second end of the adjusting rod.

9. A conveying system for one of a multiple-die press and a press line having gripper rail means extending in the conveying direction of the workpieces and carrying gripper devices that interact for gripping the workpieces, with said gripper rail means being responsive to interruptable driving movements led off the drive of the press for the lifting and lowering movement of the gripper rail means, comprising a press-driven cam means having cam parts for positioning the gripper rail means to a highest position and a lowest position, a control pulley for interacting with the cam means, a regulating means operable into positions corresponding to the highest and the lowest position of the gripper rail means and also into a position for disengaging the control pulley from the cam means, and a lever means having a pickup point coupled to the gripper rail means and a joint coupling point, and deflecting lever means coupled to the joint coupling point and coupled to the control pulley and regulating means and controlled by movement of the control pulley through its range of movement for also raising the gripper rail means from its lowest position sequentially to its highest position and for positioning the gripper rail means in a position below the highest position for admitting removal of the gripper devices.

10. A conveying system for one of a multiple-die press and a press line having gripper rail means extending in the conveying direction of the workpieces and carrying gripper devices that interact for gripping the workpieces, with said gripper rail means being responsive to interruptable driving movements led off the drive of the press for the lifting and lowering movement of the gripper rail means, comprising a press-driven cam means having cam parts for positioning the gripper rail means to a highest position and a lowest position, a control puelly on a first deflecting lever for interacting with the cam means, a regulating means operable into positions corresponding to the highest and lowest position of the gripper rail means and also into a position that disengages the control pulley from the cam means, guide rod means having a pickup point coupled at the gripper rail means and a joint coupling point, parallel guide means receiving the coupling point for motion of the coupling point in a direction substantially at right angles to the direction of the gripper rail means in its motion between its highest position and lowest position, adjusting rod means coupled at a first of its ends to the coupling point, and second deflecting means coupled to a second end of the adjusting rod and to the first deflecting lever means and the regulating means and controlled by movement of the control pulley through its range of movement for raising the gripper rail means from its lowest position sequentially to its highest position and for also positioning the gripper rail means in a position below the highest position for admitting removal of the gripper devices.

* * * * *